US007164071B2

(12) United States Patent
Pu

(10) Patent No.: US 7,164,071 B2
(45) Date of Patent: Jan. 16, 2007

(54) KEYBOARD INSTRUMENT HAVING PEDAL MECHANISM

(75) Inventor: Wenjun Pu, Hamamatsu (JP)

(73) Assignee: Yamaha Corporation (JP)

( * ) Notice: Subject to any disclaimer, the term of this patent is extended or adjusted under 35 U.S.C. 154(b) by 422 days.

(21) Appl. No.: 10/714,946

(22) Filed: Nov. 18, 2003

(65) Prior Publication Data

US 2004/0099133 A1 May 27, 2004

(30) Foreign Application Priority Data

Nov. 22, 2002 (JP) ..... 2002-340104

(51) Int. Cl.
*G10C 3/26* (2006.01)

(52) U.S. Cl. ..... 84/225

(58) Field of Classification Search ..... 84/216, 84/225, 226, 227, 228–232
See application file for complete search history.

(56) References Cited

U.S. PATENT DOCUMENTS

| | | | | |
|---|---|---|---|---|
| 2,852,973 | A * | 9/1958 | Corbett, Jr. | 84/423 R |
| 4,080,865 | A | 3/1978 | Gfell | |
| 4,879,939 | A | 11/1989 | Wall | |
| 5,565,636 | A | 10/1996 | Sugiyama | |
| 6,448,481 | B1 | 9/2002 | Maehara et al. | |
| 2001/0037718 | A1 * | 11/2001 | Maehara et al. | 84/426 |

FOREIGN PATENT DOCUMENTS

| | | |
|---|---|---|
| EP | 10-198342 | 7/1998 |
| GB | 943651 | 2/1960 |
| JP | 09-101773 | 4/1997 |
| JP | 2001-312269 | 11/2001 |
| JP | 14-014669 | 1/2002 |

OTHER PUBLICATIONS

Korean Office Action mailed Sep. 16, 2005 (English translation of relevant portion).
European Search Report mailed Apr. 22, 2004.

* cited by examiner

*Primary Examiner*—Kimberly Lockett
(74) *Attorney, Agent, or Firm*—Dickstein, Shapiro, LLP.

(57) ABSTRACT

A keyboard instrument (e.g., an electronic piano) has a keyboard including numerous actions interlocked with numerous keys arranged on a keybed, and at least one pedal (e.g., damper pedal) arranged on a base board of a housing thereof, wherein it is equipped with a pedal link mechanism including a pedal lever. A keybed reinforcing member is attached to the lower surface of the keybed and is arranged to pivotally support the pedal lever thereunder, wherein a plurality of tapered spacers are put into the space between the keybed and the keybed reinforcing member, which are thus integrally fixed together using screws. One end of the pedal lever is interconnected with the pedal via a hanging bolt, and the other end is interconnected with a vertical link interlocked with at least one action.

10 Claims, 6 Drawing Sheets

KEYBOARD INSTRUMENT HAVING PEDAL MECHANISM

BACKGROUND OF THE INVENTION

1. Field of the Invention

This invention generally relates to upright-type keyboard instruments such as upright pianos, electronic pianos, sound-mute-type pianos, automatic performance pianos (or player pianos), and in particular to pedal mechanisms adapted thereto.

This application claims priority on Japanese Patent Application No. 2002-340104, the content of which is incorporated herein by reference.

2. Description of the Related Art

Conventionally, keyboard instruments such as grand pianos, upright pianos, and other automatic performance pianos (or player pianos) incorporating automatic performance mechanisms are equipped with-pedal mechanisms such as muting (or sound-softening) mechanisms, muffler mechanisms, and damper mechanisms (or loud mechanisms), for example.

In the case of an upright piano shown in FIG. 5, a piano housing 100 has a keybed 101 arranged approximately at the center position thereof, on which keys are arranged in a keyboard 10 and are respectively operated to activate actions (or action mechanisms), wherein numerous strings are stretched under tension in a frame that is vertically arranged in the piano housing 100. Upon depression of each key 10, the action is activated to rotatably move a hammer to strike the corresponding string(s), thus producing a sound.

Specifically, the piano housing 100 comprises left/right side boards 102, a lower bottom sill 103, left/right toe blocks 104, a pair of legs 105 for supporting the keybed 101 on the toe blocks 104, a lower front board 106, an upper front board 107, a top board 108, a pair of left/right side arms 109, support poles (not shown) arranged in the rear side thereof, and a fall board 110 that is opened or closed on the keyboard 10.

Three pedals are arranged to be projected forward from the center portion of the bottom sill 103, wherein there are provided a soft pedal 25, a muffler pedal 26, and a damper pedal (or a loud pedal) 27.

An example of the conventional pedal mechanism adapted to the aforementioned upright piano is disclosed in Japanese Patent Application Publication No. 2001-312269, which corresponds to U.S. Pat. No. 6,448,481.

A muting mechanism is designed to move a hammer rail towards strings upon depression of a soft pedal so that the distance between the hammer and the string is reduced to weaken the striking force of the hammer, thus reducing the sound.

A muffler mechanism 36 (see FIG. 6) is designed to intervene a muffler felt between the action and the string upon depression of the muffler pedal 26, so that the hammer strikes the string via the muffler felt so as to weaken the sound.

A damper mechanism is designed to press the string with a damper so as to temporarily stop sound generation, wherein it is interlocked with the keyboard or the damper pedal during the performance of a piano so as to release the damper from pressing the string as necessary. Specifically, when the damper mechanism is interlocked with the keyboard only, a damper corresponding to the 'depressed' key is only being activated. When the damper mechanism is interlocked with the damper pedal only, all of dampers are collectively activated to simultaneously release all strings therefrom.

In order to activate the pedals arranged on the lower bottom sill 103, for example, the piano housing 100 is equipped with a pedal link mechanism including pedal levers.

As shown in FIG. 6, movements of the soft pedal 25 and the damper pedal 27 are respectively transmitted to vertical links 31 and 32 via pedal levers 29 and 30, which are arranged on a base board 28, so that a muting mechanism or a damper mechanism arranged in connection with an action (not shown) is activated.

The movement of the muffler pedal 26 is transmitted to the muffler mechanism 36 arranged in connection with the action via a muffler link 33, a link 34, and an interconnection link 35.

The center portions of the pedal levers 29 and 30 are pivotally supported by the base board 28 by bearing members 37 and are normally pressed in restoration directions by compression coil springs 38.

In the conventional pedal link mechanism adapted to the upright piano described above, the pedal levers 29 and 30 are individually fixed onto the upper surface of the base board 28 via the bearing members 37, wherein the compression coil springs 38 are arranged between the pedal levers 29 and 30, and the base board 28. This takes a relatively long time to fix the aforementioned members because of the complicated and troublesome assembling work in manufacture.

In order to eliminate the aforementioned drawback, Japanese Patent Application Publication No. 2001-312269 discloses a base board unit in which pivotally moving members and their bearings for pedal levers, which are pivotally moved by pedals, are combined together and are fixed to the base board or keybed of the piano housing.

The aforementioned constitution may improve the workability in fixing the pedal link mechanism that interconnects together various pedals and their operating mechanisms. However, in order to fix the base board unit including the pedal levers onto the base board of the piano housing, it is necessary to realize a sufficiently high rigidity in the base board, which in turn requires a 'rigid' bottom sill. In the case of an automatic performance piano and an electronic piano, it is necessary to provide a prescribed space for the installation of electric components such as a power source unit, an electronic sound source, and an amplifier. However, the conventional upright piano cannot provide a sufficiently large space for the installation of electric components on the base board thereof, whereby numerous components should be arranged in a relatively small space. This may cause mutual interference between electrical components and other parts, and this may also prevent heat generated by electrical components from being radiated or dissipated.

The aforementioned problem could be eliminated by fixing the base board unit including pedal levers onto the keybed, whereas the keybed is reduced in strength so as to cause a unwanted reduction of durability. As long as the pedal levers are incorporated into the base board unit, there occurs similar problems in fixing the base board unit to any position of the piano housing. In addition, there occur other problems due to restrictions regarding the freedom of design and actual operations with regard to arranging positions of bearings, restoration springs, and the like.

SUMMARY OF THE INVENTION

It is an object of the invention to provide an upright-type keyboard instrument having various pedals and their operating mechanism, in which a sufficiently large space for the installation of electric components and other parts can be securely arranged on a base board of a keyboard housing without causing an unwanted reduction of durability of the base board, wherein no restriction is caused to occur in terms of the design and actual operation of a pedal link mechanism.

A keyboard instrument (e.g., an electronic piano) has a keyboard including numerous actions interlocked with numerous keys arranged on a keybed, and at least one pedal (e.g., damper pedal) arranged on a base board of a housing thereof, wherein it is equipped with a pedal link mechanism including a pedal lever. That is, a keybed reinforcing member is attached to the lower surface of the keybed and is arranged to pivotally support the pedal lever thereunder, wherein a plurality of tapered spacers are put into the space between the keybed and the keybed reinforcing member, which are thus integrally fixed together using screws.

In the above, the pedal lever can be pivotally supported by a pedal lever support board that is fixedly attached to the lower surface of the keybed reinforcing member. One end of the pedal lever is interconnected with the pedal via a hanging bolt, for example, and the other end is interconnected with a vertical link interlocked with at least one action.

Because the pedal lever is arranged at a relatively higher position within the housing of the keyboard instrument, it is possible to securely arrange a relatively large space for the installation of electric components and other parts on the base board of the housing without damaging the durability because of the provision of the keybed reinforcing member.

BRIEF DESCRIPTION OF THE DRAWINGS

These and other objects, aspects, and embodiments of the present invention will be described in more detail with reference to the following drawings, in which.

DESCRIPTION OF THE PREFERRED EMBODIMENT

This invention will be described in further detail by way of examples with reference to the accompanying drawings.

Figure 1:
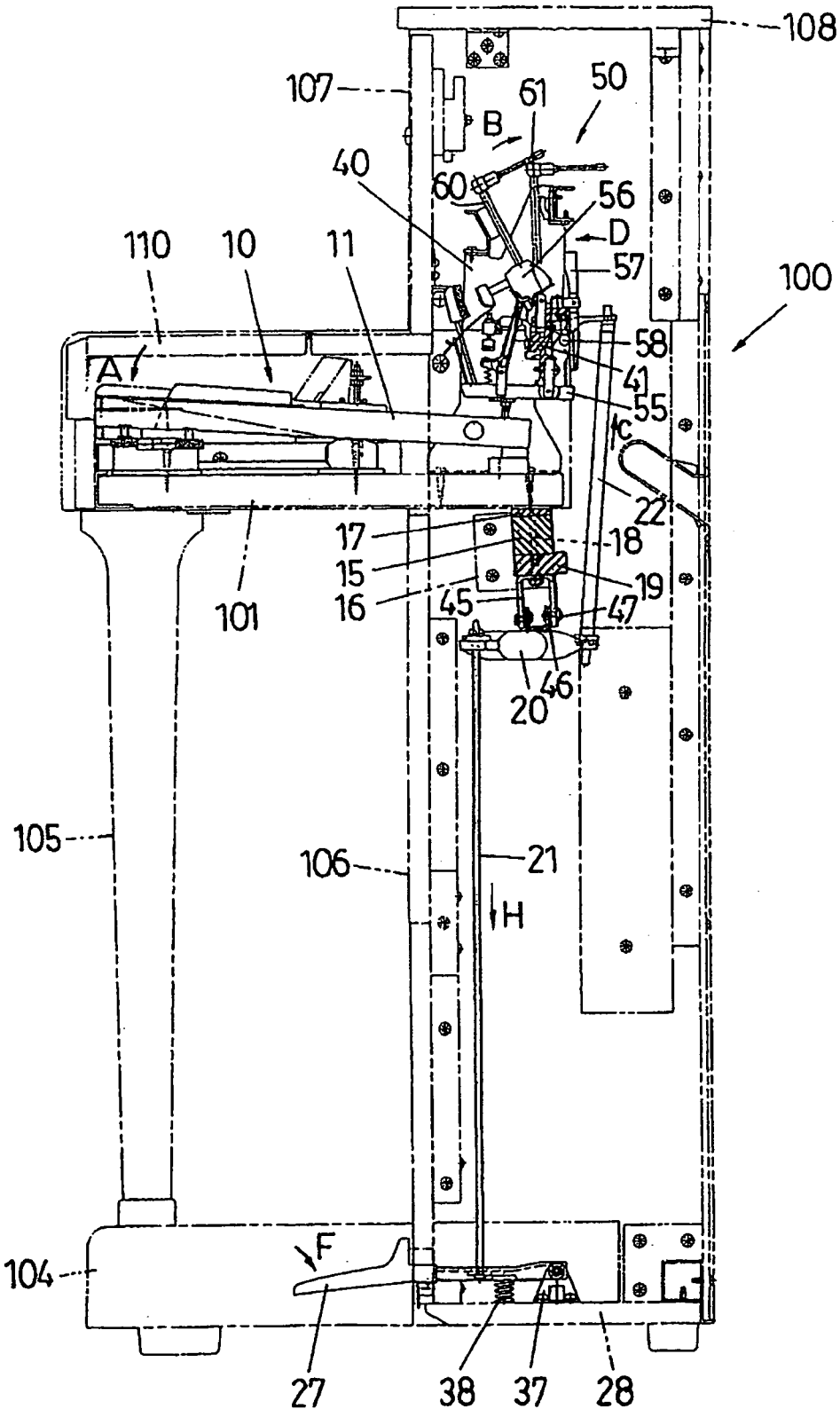
FIG. 1 is a cross-sectional side view showing the internal structure of an electronic piano in accordance with an embodiment of the invention.
Figure 2:
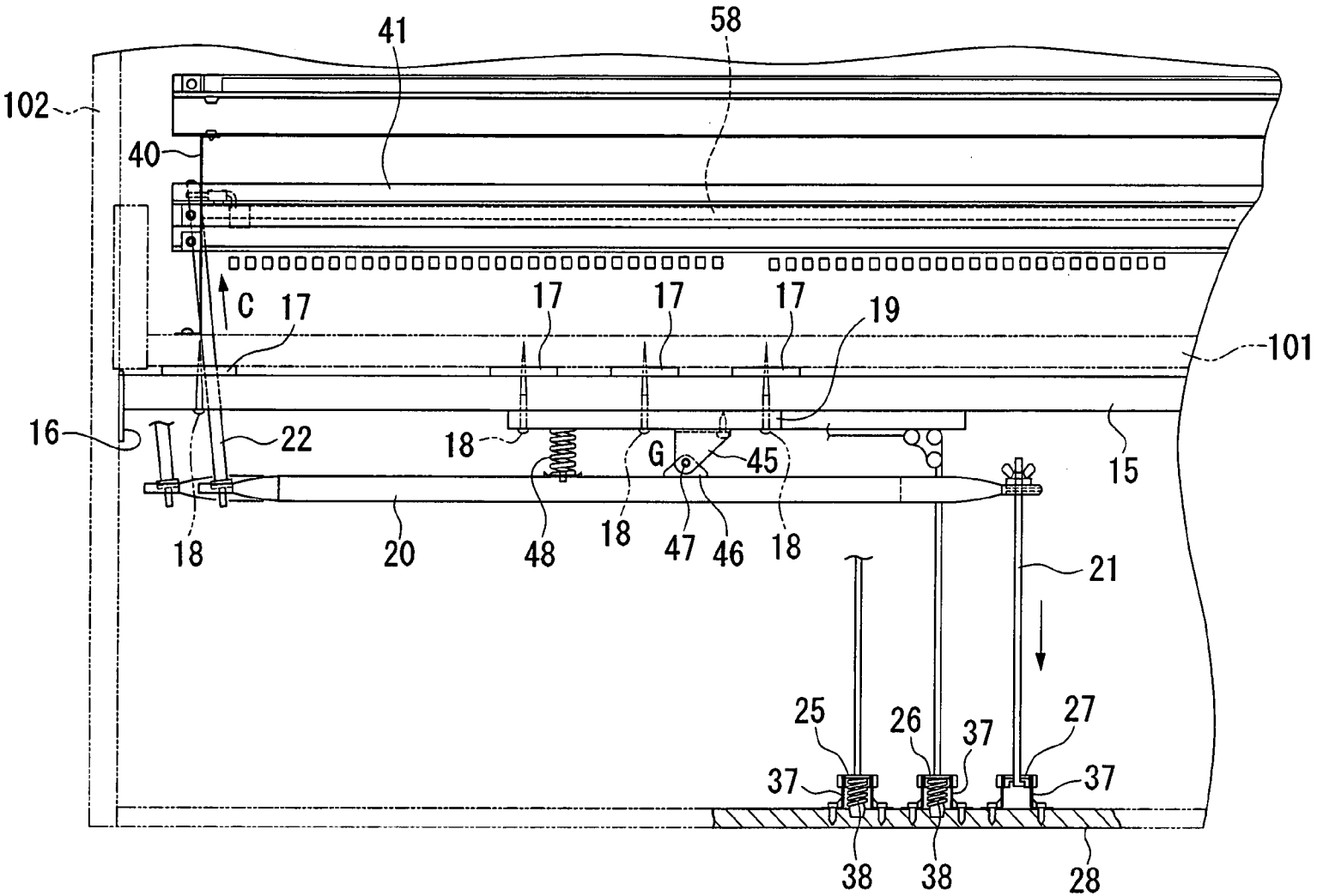
FIG. 2 is a cross-sectional front view showing essential parts of a pedal link mechanism adapted to the electronic piano.
Figure 3:
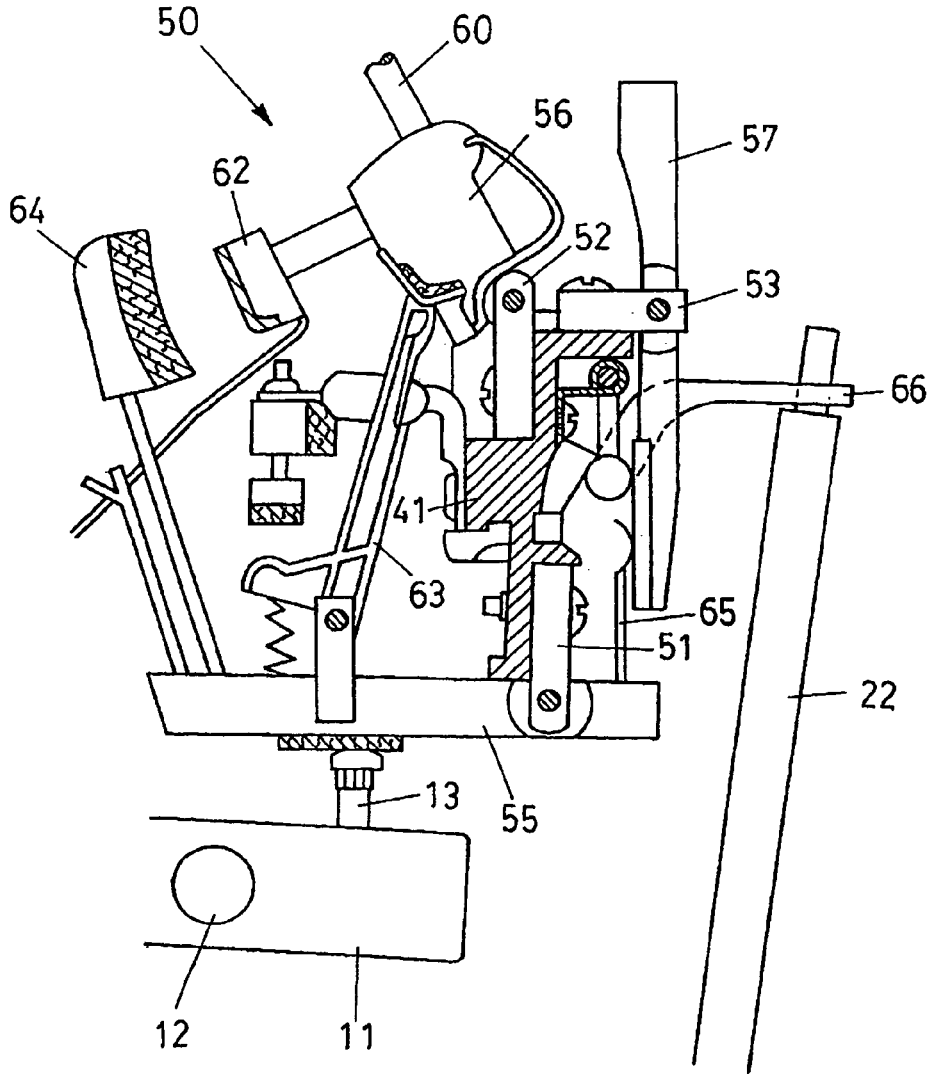
FIG. 3 is an enlarged side view showing essential parts of an action interlocked with a key of a keyboard of the electronic piano.
Figure 4:
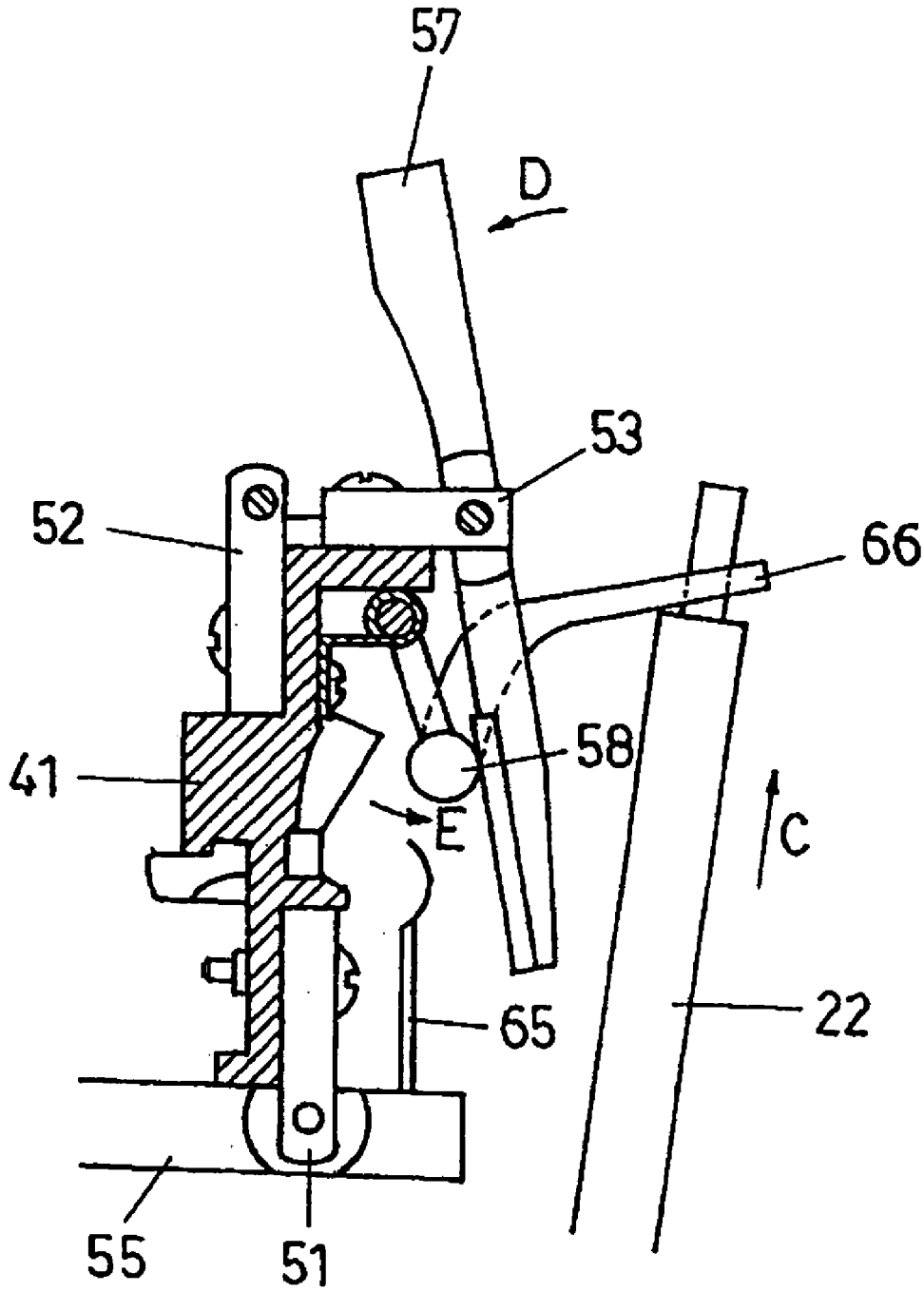
FIG. 4 is a fragmentary side view showing prescribed parts of the action including a damper lever that is moved upon depression of a damper pedal.

FIG. 1 is a cross-sectional side view showing the internal structure of an electronic piano in accordance with an embodiment of the invention, and FIG. 2 is a cross-sectional front view showing essential parts of a pedal link mechanism adapted to the electronic piano. FIG. 3 is an enlarged side view showing essential parts of an action (or an action mechanism) adapted to the electronic piano, and FIG. 4 is a fragmentary side view showing prescribed parts of the action including a damper lever that is moved upon depression of a damper pedal.

Figure 5:
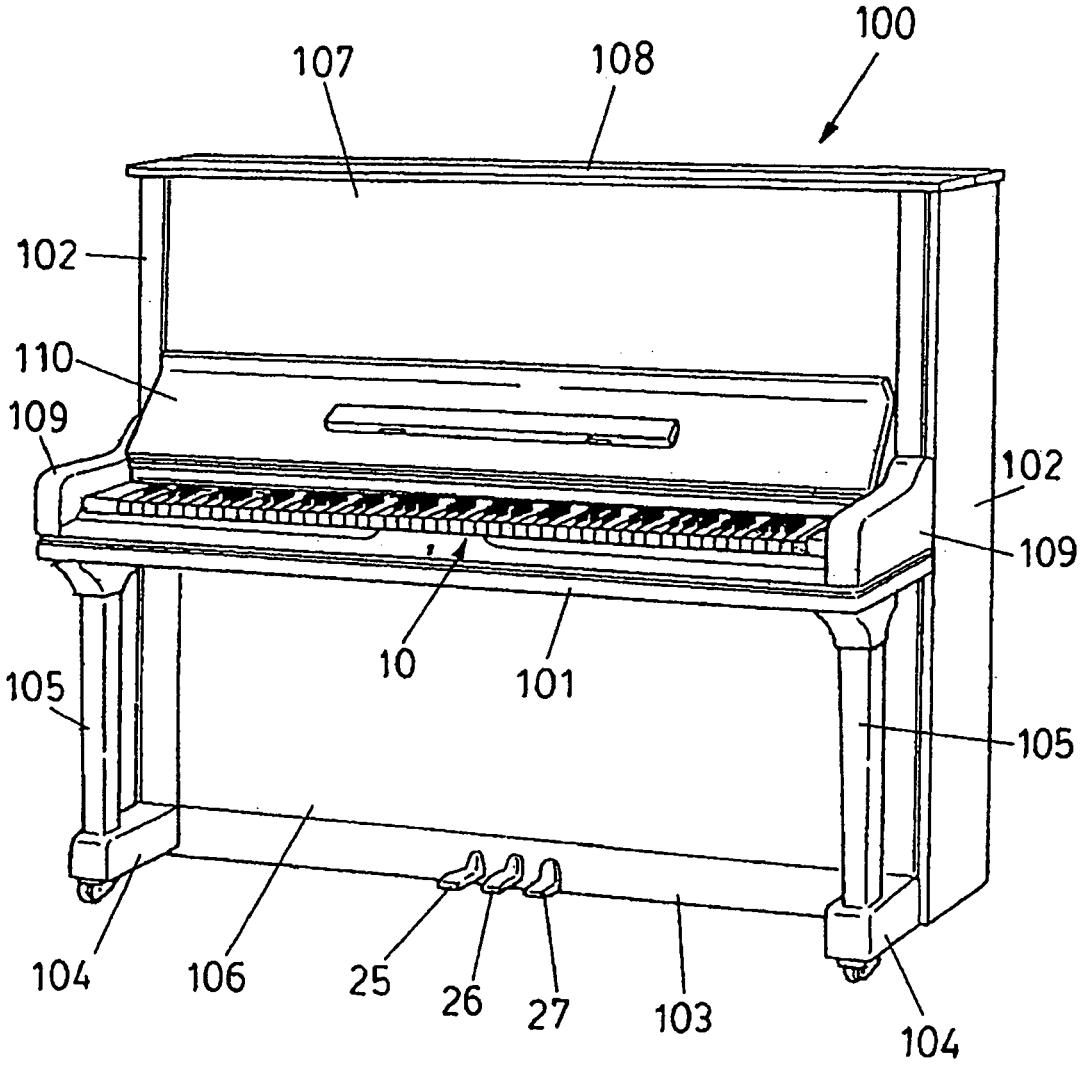
FIG. 5 is a perspective view showing the exterior appearance of a upright piano, which is a conventional example of a keyboard instrument.
Figure 6:
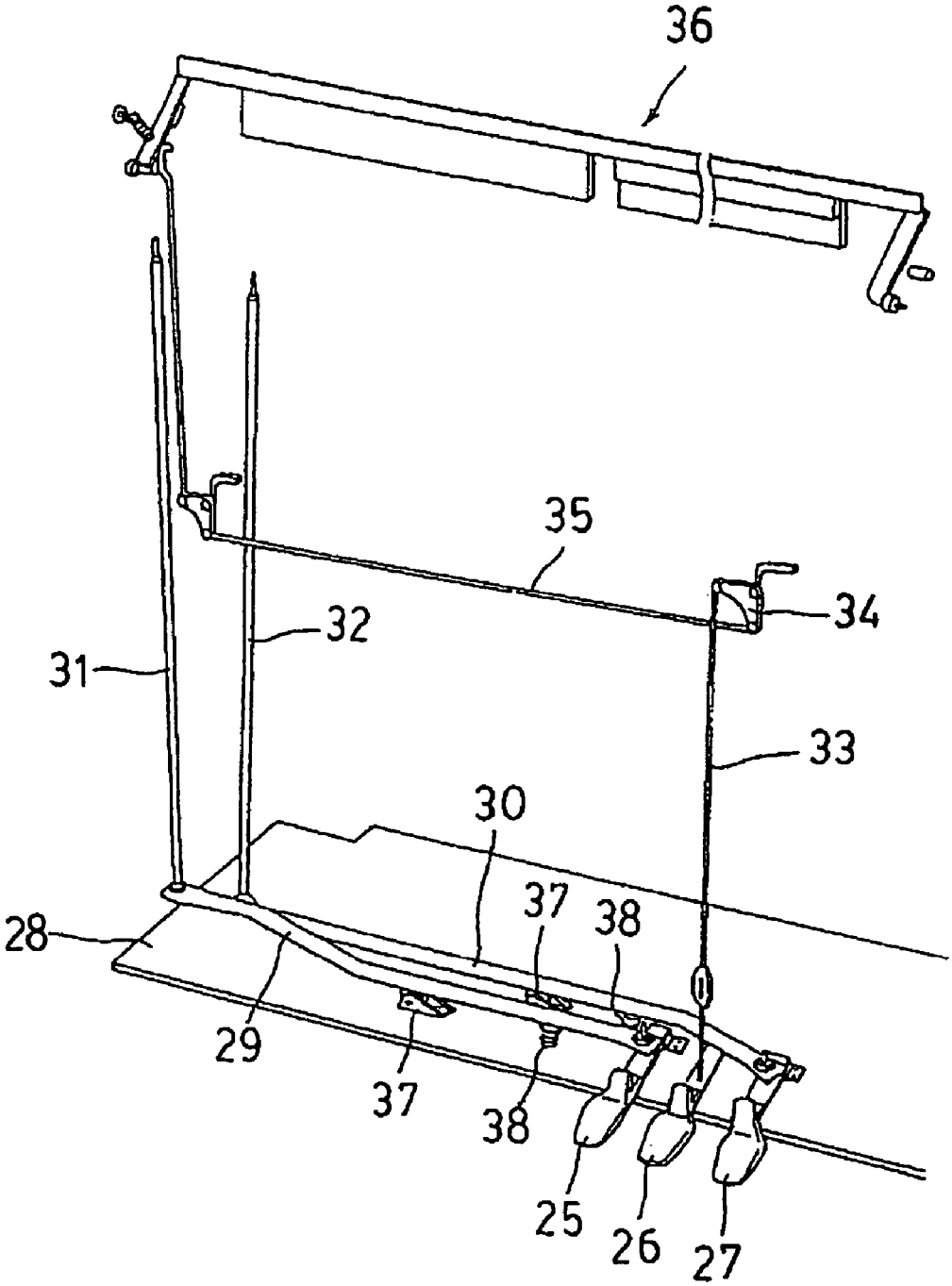
FIG. 6 is an exploded perspective view showing essential parts of a conventional pedal link mechanism adapted to the upright piano.

The exterior appearance of the electronic piano shown in FIG. 1 is similar to that of the upright piano shown in FIG. 5; therefore, parts identical to those shown in FIGS. 5 and 6 are designated by the same reference numerals in FIGS. 1 and 2; hence, the detailed description thereof will be omitted as necessary. In FIGS. 1 and 2, outlines defining a piano housing are drawn with imaginary lines (e.g., dashed lines).

In FIG. 1, numerous keys (including white keys and black keys) 11 are arranged on a keybed 101 of a keyboard 10, which is arranged approximately at the center portion of a piano housing 100. Each of the keys 11 can be pivotally moved about a shaft 12, whereby an action (or an action mechanism) 50 driven by the key 11 is arranged above the backend portion of the key 11 in the rear side of the keyboard 10. The action 50 is arranged for each of the keys 11, wherein it is supported by a bracket 40 vertically arranged on the keybed 101 and is also supported by a center rail 41 that is horizontally arranged across all registers of the keyboard 10.

Details of the action 50 is shown in FIG. 3, in which a whippen 51, butt flange 52, a damper lever flange 53, and a damper rod hinge 54 are respectively fixed to the center rail 41. Specifically, a whippen 55 is pivotally supported by the whippen flange 51; a butt 56 is pivotally supported by the butt flange 52; a damper lever 57 is pivotally supported by the damper lever flange 53; and a damper rod 58 is pivotally supported by the damper rod hinge 54.

A hammer shank 60 whose tip end portion is equipped with a hammer 61 (see FIG. 1) and a catcher 62 are respectively fixed to the butt 56. Since the electronic piano is designed to generate sounds using an electronic sound source, the hammer 61 does not necessarily strike a string (or strings). For this reason, the hammer 61 is not normally equipped with a hammer felt.

In addition, the damper level 57 does not necessarily press the string to stop its vibration. For this reason, the damper lever 57 is not equipped with a damper felt.

In FIG. 3, a jack 63 is supported by the whippen 55, on which a back check 64 and a damper spoon 65 are respectively fixed.

Furthermore, a capstan button 13 is fixed onto the upper surface of the backend portion of the key 11 of the keyboard 10.

The constitution and operation of the action 50 described above are substantially similar to those of the action conventionally installed in the generally-known upright piano; therefore, the detailed description regarding functions of the action 50 will be omitted, whereas a hammer operation and an operation of the damper mechanism at a key-depression mode will be briefly described below.

When the key 11 is depressed in a direction A in FIG. 1, the capstan button 13 attached to the upper surface of the backend portion of the key 11 moves upwards and presses the whippen 55 to move in a clockwise direction, so that the jack 63 presses the butt 56 to move in a clockwise direction. Thus, the hammer shank 60 and the hammer 61 rotates in a direction B to reach a prescribed position, which is indicated by imaginary lines in FIG. 1.

At this time, a key switch (not shown) detects the depression of the key 11 so as to generate a detection signal, which in turn activates the electronic sound source to generate a musical tone signal having a pitch corresponding to the depressed key.

The damper mechanism is constituted by damper levers 57, which are arranged for the keys 11 respectively, a damper rod 58 that is horizontally elongated and is commonly arranged for all the keys 11 (see dotted lines in FIG. 2), and an interconnection lever 66 fixed to one end of the damper rod 58. One end of the interconnection lever 66 is loosely engaged with the upper end of a vertical link 22 interlocked with a damper lever 27.

In a key-depression mode, due to the clockwise rotation of the whippen 55, the damper spoon 65 presses the damper lever 57 only so that the damper lever 57 rotatably moves in a direction D, in which the damper felt moves to be distant from the string in the case of an upright piano.

When the damper pedal 27 is depressed, the vertical link 22 moves upwards in a direction C (see FIGS. 1 and 4) by way of a pedal link mechanism, details of which will be described later, so that the interconnection lever 66 operates to rotatably move the damper rod 58 in a direction E (see FIG. 4). Thus, it is possible to collectively rotate all of the damper levers 57 engaged with the damper rod 58 in the direction D.

Next, the pedal link mechanism and the structure for the installation of pedal levers according to the present embodiment will be described in detail with reference to FIGS. 1 and 2.

A keybed reinforcing member 15 that is made of an square bar (timber) or an iron pipe having a roughly square cross-sectional shape is fixed to a prescribed position below the keybed 101 of the piano housing 100, wherein both ends of the keybed reinforcing member 15 are fixed to the interior surfaces of the side boards 102 via side board fixing members 16 respectively.

A plurality of tapered spacers 17 each having a wedge-like shape are put into the space between the keybed 101 and the keybed reinforcing member 15 at prescribed positions, which are spaced apart from each other with prescribed distances therebetween. They are integrally fixed to the keybed 101 via screws 18 together with the keybed reinforcing member 15, in which a pedal lever support board 19 is attached to the lower surface of the keybed reinforcing member 15.

A lever support 45 is fixedly attached to the lower surface of the pedal lever support board 19, so that it is interconnected with the pedal lever 20 to be rotated about a lever support bearing 46 and a shaft 47, which are fixedly attached to the pedal lever 20. As a result, the pedal lever support board 19 pivotally supports the pedal lever 20 to be moved in a direction G (see FIG. 2). In addition, a compression spring 48 for use in the positional restoration is arranged between the pedal lever support board 19 and the pedal lever 20.

One end of the pedal lever 20 is interconnected with a hanging hole of the damper pedal 27 via a hanging bolt 21, which is a rod-like member having external threads at both ends thereof, in such a way that both ends of the hanging bolt 21 are loosely screwed with the pedal lever 20 and the damper pedal 27. The lower end of the vertical link 22 is inserted into and interconnected with a hole formed at the other end of the pedal lever 20.

In the above, the pivotal movement of the pedal lever 20 about the shaft 47 is realized at a prescribed supporting point, which is located closer to the hanging bolt 21 from the center of the pedal lever 20 in its overall length. For this reason, when the damper pedal 27 is depressed in a direction F so that the hanging bolt 21 is descended down in a direction H (see FIG. 1), the pedal lever 20 pivotally moves in the direction G, whereby such pivotal movement is enlarged to push up the vertical link 22 in the direction C.

Then, as shown in FIG. 4, the interconnection rod 66 moves the damper rod 58 to rotate in the direction E, so that all of the damper levers 57 are collectively rotated in the direction D. Since the electronic piano is not designed to normally press the string by the damper lever 57 that is not accompanied with a damper felt, even when the user (or player) depresses the damper pedal 27, the damper felt is not released from the string. In other words, the aforementioned structure merely provides the user with a pedal operating feeling (or sensation) similar to that of the conventional upright piano.

The aforementioned description is provided with respect to the damper mechanism (similar to the loud mechanism) and its pedal link mechanism, which are operated by the damper pedal 27. This can be similarly applied to the pedal link mechanisms respectively adapted to the muting mechanism (or sound-softening mechanism) operated by the soft pedal and the muffler mechanism operated by the muffler pedal 26. In addition, the similar pedal link mechanism and its fixing structure can be applied to other pedal mechanisms to be additionally adapted to the keyboard instrument.

According to the present embodiment described above, the keybed reinforcing member 15 for reinforcing the keybed 101 is arranged under the keybed 101 of the piano housing 100, and a plurality of tapered spacers 17 each having a wedge-like shape are put into the space between the keybed 101 and the keybed reinforcing member 15, wherein the keybed reinforcing member 15 and the tapered spacers 17 are integrally fixed together with the keybed 101 by screws, so that the pedal lever 20 is arranged under and pivotally supported by the keybed reinforcing member 15. Therefore, it is possible to produce a sufficiently high strength for the keybed 101 and the pedal mechanism adapted thereto. That is, even when an intense force is applied to the pedal mechanism upon operation of a pedal, it is possible not to damage the durability with regard to the pedal mechanism adapted to the keyboard instrument.

Unlike the conventional keyboard instrument, the present embodiment does not arrange the pedal lever on the base board 28; therefore, it is possible to securely provide a sufficiently large space for use in the installation of electric components and other parts. That is, this invention functions very effectively in the electronic piano and automatic performance piano. Of course, this invention can be similarly applied to acoustic pianos such as upright pianos.

The present embodiment can further increase the strength of the pedal mechanism adapted to the keyboard instrument because the keybed 101 and the keybed reinforcing member 15 are integrally fixed together by firmly arranging the tapered spacers 17 therebetween. Herein, the tapered spacers 17 are not necessarily essential to this invention; hence, it is possible to omit them as necessary.

In addition, the aforementioned hanging bolt is not necessarily used as an interconnection member for interconnecting between the pedal and the pedal lever. That is, it is possible to use other means such as a rod-like member, a wire, and a chain for interconnecting therebetween.

As described heretofore, this invention has a variety of effects and technical features, which will be described below.

(1) Due to a sophisticated pedal link structure adapted to a keyboard instrument (e.g., an electronic piano) having a pedal mechanism, this invention can securely guarantee a sufficiently large space for use in the installation of electric components and other parts on a base board of a piano housing while securing a sufficiently great durability. Herein, this invention is advantageous in that substantially no restriction is required for the design and operation of the pedal link mechanism.

(2) Specifically, this invention is adapted to an upright-type keyboard instrument in which a keyboard is realized by numerous keys arranged on a keybed, which is arranged approximately at the center portion of the piano housing, and actions respectively driven by the keys, wherein a pedal link mechanism is realized using a pedal lever for transmitting an operation of a pedal, which is arranged in proximity to a base board of the piano housing, to the action(s). This invention is characterized by arranging a keybed reinforcing member under the keybed, and the pedal lever is interconnected to and is supported by the keybed reinforcing member.

(3) In the above, wedge-like members (e.g., tapered spacers) are put into the space between the keybed and the keybed reinforcing member, so that the wedge-like members and the keybed reinforcing member are integrally fixed together with the keybed by use of screws and the like.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What is claimed is:

1. An upright electric piano in which a plurality of keys are arranged on a keybed, and a plurality of actions are arranged in connection with the plurality of keys respectively, said upright electric piano comprising:

a pedal link mechanism including a pedal lever for transmitting operation of a pedal, arranged on a base board of the housing, to at least one of the plurality of actions; and a keybed reinforcing member that is arranged under the keybed so as to pivotally support the pedal lever thereunder wherein the pedal lever mechanism is connected to the keybed via the keybed reinforcing member.

2. An upright electric piano according to claim 1, wherein the keybed is arranged approximately at a center portion of a housing.

3. An upright electric piano according to claim 1, wherein a plurality of wedge-like members are put into a space between the keybed and the keybed reinforcing member, so that the keybed reinforcing member and the plurality of wedge-like members are integrally fixed together with the keybed by use of screws.

4. An upright electric piano according to claim 1, wherein one end of the pedal lever is interconnected with the pedal via a hanging bolt.

5. An upright electric piano according to claim 4, wherein the other end of the pedal lever is interconnected with a vertical link interlocked with at least one of the actions.

6. A pedal link mechanism adapted to an upright electric piano in which a plurality of keys arranged on a keybed are interlocked with a plurality of actions (50) in a housing, comprising:

a pedal arranged on a base board of the housing;

a keybed reinforcing member fixed to a lower surface of the keybed; and a pedal lever, one end of which is interconnected with the pedal and which is pivotally supported under the keybed reinforcing member wherein the pedal lever mechanism is connected to the keybed via the keybed reinforcing member.

7. A pedal link mechanism adapted to an upright electric piano in which a plurality of keys arranged on a keybed are interlocked with a plurality of actions (50) in a housing, comprising:

a pedal arranged on a base board of the housing;

a keybed reinforcing member fixed to a lower surface of the keybed; and a pedal lever, one end of which is interconnected with the pedal and which is pivotally supported under the keybed reinforcing member wherein the pedal lever mechanism is connected to the keybed via the keybed reinforcing member further comprising a pedal lever support board that is fixedly attached to a lower surface of the keybed reinforcing member so as to pivotally support the pedal lever interlocked with the pedal via a hanging bolt.

8. The pedal link mechanism adapted to an upright electric piano according to claim 7, wherein the other end of the pedal lever is interconnected with a vertical link interlocked with at least one of the plurality of actions.

9. The pedal link mechanism adapted to an upright electric piano according to claim 7 further comprising a pivotal movement means by which the pedal lever is pivotally supported by the pedal lever support board.

10. The pedal link mechanism adapted to an upright electric piano according to claim 7 further comprising a plurality of tapered spacers that are put into a space between the keybed and the keybed reinforcing member.

* * * * *